United States Patent [19]

Yawberg

[11] Patent Number: 4,805,374

[45] Date of Patent: Feb. 21, 1989

[54] FIBROUS INSULATION BATT DELIVERING MACHINE

[75] Inventor: Richard C. Yawberg, Grand Rapids, Ohio

[73] Assignee: Owens-Corning Fiberglas Corporation, Toledo, Ohio

[21] Appl. No.: 120,061

[22] Filed: Nov. 13, 1987

[51] Int. Cl.[4] ..... B65B 63/04

[52] U.S. Cl. ..... 53/120; 270/32

[58] Field of Search ..... 53/429, 117, 120, 116; 270/32; 271/7, 225, 198, 213

[56] References Cited

U.S. PATENT DOCUMENTS

| | | | |
|---|---|---|---|
| 3,327,449 | 6/1967 | Hullhorst et al. . | |
| 3,382,643 | 5/1968 | Hullhorst | 53/529 X |
| 3,458,966 | 8/1969 | Dunbar et al. . | |
| 3,499,261 | 3/1970 | Hullhorst et al. | 53/529 X |
| 3,766,701 | 10/1973 | Besserdich et al. | 53/120 X |
| 3,824,759 | 7/1974 | Finn et al. | 53/529 X |
| 4,021,993 | 5/1977 | Widmer | 53/120 |
| 4,106,260 | 8/1978 | King | 53/120 X |
| 4,640,082 | 2/1987 | Gill . | |
| 4,697,944 | 10/1987 | Peebles et al. | 271/198 X |

*Primary Examiner*—Horace M. Culver

*Attorney, Agent, or Firm*—Patrick P. Pacella; Ted C. Gillespie

[57] ABSTRACT

Apparatus for delivering fibrous insulation batts comprises an upstream batt receiving section and a downstream batt delivering station, the upstream batt receiving station being adapted for two modes of operation, the first mode being for folding batts and delivering folded batts to the downstream batt delivering station and the second mode for delivering unfolded batts to the downstream batt delivering station, the upstream batt receiving station comprising a conveyor belt for transporting batts through the upstream batt receiving station, a plurality of rolls for guiding the conveyor belt along a first path in the first mode of operation, means for moving at least one of the rolls to guide the conveyor belt along a second path for the second mode of operation, a support member spaced apart from the conveyor, thereby defining a gap between the conveyor belt in the first mode of operation and the support member, the support member being adapted to support a portion of the batt as it is transported off the downstream end of the conveyor belt, a folding plate member reciprocally mounted to engage the batt near its midsection and push the batt through the gap and into engagement with the downstream batt delivering station, thereby folding the batt.

2 Claims, 1 Drawing Sheet

FIBROUS INSULATION BATT DELIVERING MACHINE

TECHNICAL FIELD

This invention relates generally to machines for packaging fibrous batts of thermal insulation, and more particularly to machines for transporting such batts.

BACKGROUND ART

U.S. Pat. No. 3,327,449, issued to Hullhorst and Lockett on June 27, 1967, discloses a machine wherein a stack of batts is mechanically compressed and vacuum is applied by a vacuum shoe along a longitudinal edge portion of the compressed stack. A paper sheet is wrapped around the stack and the vacuum shoe and the edges of the sheet are glued together over the vacuum shoe.

U.S. Pat. No. 3,382,643, issued to Hullhorst on May 14, 1968, discloses apparatus wherein a sidewall vacuum plenum of a compression station is used to move a stack of batts into the compression station from a loading station. A pressure plenum forming a lower platen of the compression station aids movement of a compressed stack by a cross ram into a bag.

U.S. Pat. No. 3,458,966, issued to Dunbar and Hullhorst on Aug. 5, 1969, discloses a method of pneumatically compressing fibrous batts by enclosing a stack in a plastic bag and evacuating air out of the bag endwise. A restraining sleeve is slipped over the bag and stack after they are compressed by ambient air pressure.

U.S. Pat. No. 3,499,261, issued to Hullhorst, Brown, and Mosier on Mar. 10, 1970, discloses three embodiments of packaging apparatus. FIGS. 1 and 2 disclose an open-top chamber into which a wrapping sheet and a stack of batts are placed. Endwall vacuum plenums evacuate air endwise out of the batts. A bottom wall pressure plenum ejects a wrapped stack. FIGS. 3 and 4 disclose means for compressing a stack of batts horizontally while a bottom wall vacuum plenum evacuates air transversely of the batts parallel to their major surfaces. FIGS. 5–10 disclose the apparatus of U.S. Pat. No. 3,382,643 mentioned above.

U.S. Pat. No. 3,824,759, issued to Finn and Smith on July 23, 1974, discloses apparatus wherein stacks of batts are partially compressed between sets of fingers at a loading station and then moved to a compression station having a sidewall vacuum plenum for holding the partially compressed stacks in the compression station while the loading fingers are withdrawn.

A problem with existing batt packaging machines and methods is that when longer batts, such as 8 foot batts, are used, they must be folded. This has traditionally been a labor intensive process. There is a need for an improved method and apparatus for automatically folding batts. Also, there is a need for such equipment to be flexible enough to enable rapid changeover and back from a mode in which the batts are folded to a mode in which the batts are unfolded.

DISCLOSURE OF THE INVENTION

In accordance with the invention, a fibrous batt packaging machine is disclosed wherein fibrous batts are transported on a conveyor and are automatically folded and delivered to a batt packaging machine. In another mode of operation, batts of a predetermined shorter length are packaged without being folded.

BRIEF DESCRIPTION OF THE DRAWINGS

The invention is hereinafter more fully explained, reference being had to the accompanying drawing wherein.

BEST MODE OF CARRYING OUT THE INVENTION

Figure 1:
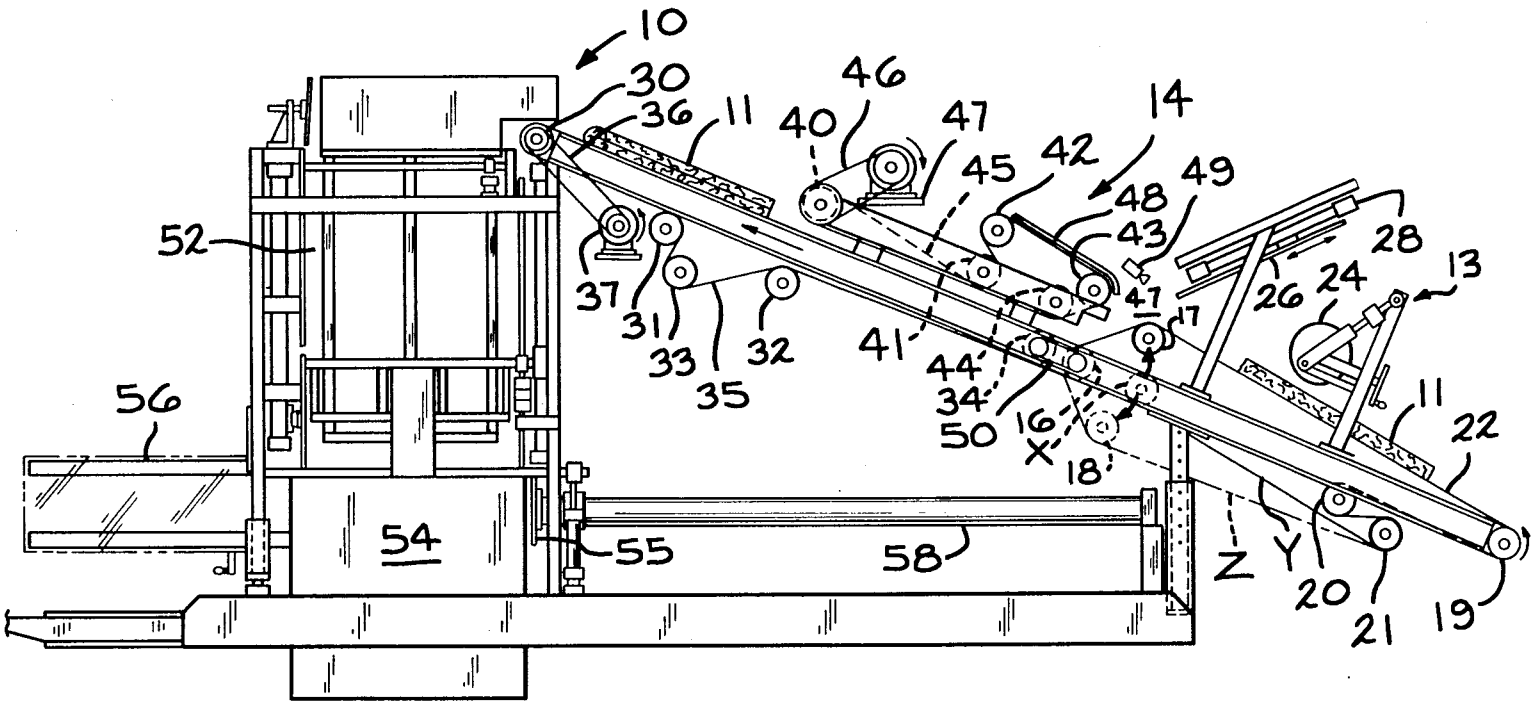
FIG. 1 is a schematic side elevational view of a fibrous insulation batt packaging machine constructed in accordance with the invention.

With reference to the drawings, FIG. 1 shows a packaging machine 10 constructed in accordance with the invention and including an inclined infeed conveyor system 12 for receiving fibrous batts 11, for example, from a glass fiber batt forming machine (not shown) and a connecting conveyor (not shown). The inclined conveyor system 12 includes an upstream batt-receiving section 13 and a downstream batt-delivering section 14. The upper end of the upstream section 13 is adjustable to provide two different modes of operation and includes an upper end roll 16, a roll 17, and a roll 18. As will be understood, the rolls 17 and 18 are mounted on triangular framework (not shown) pivotable about the axis of the upper end roll 16. In a first mode of operation wherein batts of a predetermined longer length are folded lengthwise before packaging, the framework is pivoted upwardly so that the roll 17 is in the position shown and the roll 18 is in the position marked "X". In a second mode of operation wherein batts of a predetermined shorter length are packaged without being folded, the framework is pivoted downwardly so that the roll 17 is in the position marked "X" and the roll 18 is in the position shown. Other rolls of the upstream section 13 include a lower end roll 19, an idler roll 20, and an adjustable take-up roll 21. An endless conveyor belt or chain 22 travels around the rolls 16-21, a lower flight of the chain 22 being in the position marked "Y" in the first mode of operation and in the position marked "Z" in the second mode of operation. An adjustable pinch roll or hold-down roll 24 is mounted on suitable framework of the section 13. Further, a reciprocable plate member 26 operable by a pneumatic actuator 28 or any other suitable means is mounted on suitable framework of the section 13 for initiating the lengthwise folding of fibrous batts of a predetermined longer length.

The downstream section 14 includes an upper end roll 30, a pair of idler rolls 31 and 32, an adjustable take-up roll 33, and a lower end roll 34. An endless conveyor belt or chain 35 travels around the rolls 30-34. The roll 30 is driven by an endless drive chain 36 operatively connected to the roll 30 and to a motor 37. The downstream section 14 also includes suitable framework for the mounting of a plurality of rolls 40, 41, 42, 43, and 44 around which an endless belt or chain 45 travels. The belt 45 is driven by an endless drive chain 46 operatively connected to the roll 40 and to a motor. The lower flight of the belt 45 between the rolls 40 and 44 cooperates with the upper flight of the belt 35 between the rolls 30 and 34 to yieldingly grip the fibrous batts and move them upwardly therebetween. A support, such as skid plate 48 is suitably mounted adjacent and above an upper flight of the belt 45 between the rolls 42 and 43. The skid plate supports half of the batt during the folding process. The skid plate is separated from the conveyor belt 22 by gap 47. The roll 16 of the section 13 and the roll 34 of the section 14 are operatively connected by an endless chain 50, whereby the belts 22 and 35 are driven at the same speed by the motor 37.

When the rolls 17 and 18 and the belt 22 are in the first mode of operation, batts of a predetermined longer length progress from the belt 22 part way across the skid plate 48 until the approximate midpoint of the length of the batt is in the gap between the roll 17 and the roll 43. The folding plate member 26 is then reciprocated by the actuator 28 to move the midpoint of the batt between the belts 22 and 45, causing folding to occur as the midpoint moves farther into the gap between the belts 35 and 45. Sensor 49 senses the movement of a batt across the gap 47 and activates the folding plate member at the appropriate time.

When the rolls 17 and 18 and the belt 22 are in the second mode of operation, batts of a predetermined shorter length progress along an upper flight (not shown) of the belt 22 between the rolls 16 and 19 until a leading edge of a batt is gripped between the belts 35 and 45, the folding plate 26 being inactive in this second mode.

The batts are fed by the belt 35 into a stacking framework 52, dropped into any suitable batt packaging apparatus such as compression chamber 54 wherein they are compressed, and pushed out of the compression chamber by a reciprocally mounted pushing plate 55 as a compressed stack into the bagging apparatus 56. The pushing plate 55 is reciprocated by any suitable pushing means, such as pneumatic actuator 58.

Various modifications may be made in the structure shown and described without departing from the scope of the invention as set forth in the following claims.

I claim:

1. Apparatus for delivering fibrous insulation batts comprising an upstream batt receiving section and a downstream batt delivering station, the upstream batt receiving station being adapted for two modes of operation, the first mode being for folding batts and delivering folded batts to the downstream batt delivering station and the second mode for delivering unfolded batts to the downstream batt delivering station, the upstream batt receiving station comprising a. a conveyor belt for transporting batts through the upstream batt receiving station, b. a plurality of rolls for guiding the conveyor belt along a first path in the first mode of operation, and c. means for moving at least one of the rolls to guide the conveyor belt along a second path for the second mode of operation, a support member spaced apart from the conveyor, thereby defining a gap between the conveyor belt in the first mode of operation and the support member, the support member being adapted to support a portion of the batt as it is transported off the downstream end of the conveyor belt, and a folding plate member reciprocally mounted to engage the batt near its midsection and push the batt through the gap and into engagement with the downstream batt delivering station, thereby folding the batt.

2. The apparatus of claim 1 further comprising means for sensing movement of a batt across the gap and for activating reciprocal movement of the folding plate member in response to the sensed movement.

* * * * *